US011128943B2

(12) United States Patent
Hatfield et al.

(10) Patent No.: US 11,128,943 B2
(45) Date of Patent: Sep. 21, 2021

(54) EARPHONES

(71) Applicant: Apple Inc., Cupertino, CA (US)

(72) Inventors: Dustin A. Hatfield, Los Gatos, CA (US); Eugene A. Whang, San Francisco, CA (US); Robert A. Boyd, Los Angeles, CA (US); Duy P. Le, Los Angeles, CA (US); Yi-Fang D. Tsai, Mountain View, CA (US); David J. Feathers, San Jose, CA (US); Shota Aoyagi, San Francisco, CA (US); Sean S. Corbin, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/564,804

(22) Filed: Sep. 9, 2019

(65) Prior Publication Data

US 2020/0314518 A1 Oct. 1, 2020

Related U.S. Application Data

(60) Provisional application No. 62/823,557, filed on Mar. 25, 2019.

(51) Int. Cl.
*H04R 1/10* (2006.01)

(52) U.S. Cl.
CPC ..... *H04R 1/1016* (2013.01); *H04R 1/105* (2013.01); *H04R 1/1041* (2013.01); *H04R 1/1075* (2013.01); *H04R 2420/07* (2013.01)

(58) Field of Classification Search
CPC .... H04R 1/1016; H04R 1/1041; H04R 1/105; H04R 1/1075; H04R 2420/07
See application file for complete search history.

(56) References Cited

U.S. PATENT DOCUMENTS

| | | | | |
|---|---|---|---|---|
| 8,879,722 | B1 * | 11/2014 | Wang | H04R 1/1041 379/430 |
| D725,637 | S * | 3/2015 | Nakajima | D14/223 |
| 10,110,984 | B2 * | 10/2018 | Rich | H04R 1/1075 |
| 2007/0049361 | A1 * | 3/2007 | Coote | H04R 1/1066 455/575.2 |
| 2016/0014492 | A1 * | 1/2016 | McCarthy | H04R 1/1091 381/74 |
| 2017/0078780 | A1 * | 3/2017 | Qian | H04R 1/406 |
| 2018/0275950 | A1 * | 9/2018 | Takagi | A61B 5/6803 |
| 2019/0182576 | A1 * | 6/2019 | Pierce | H04R 1/1016 |
| 2020/0154196 | A1 * | 5/2020 | Kolton | H04R 1/105 |

* cited by examiner

*Primary Examiner* — Jason R Kurr
(74) *Attorney, Agent, or Firm* — Kilpatrick Townsend & Stockton LLP

(57) ABSTRACT

An earpiece is described that includes a driver housing that encloses an audio driver. The driver housing is oriented so that a first end of the driver housing can be supported by a concha bowl of a user's ear and a second end opposite the first end can tilt outside of the user's ear so that the ear need not accommodate an entirety of the driver housing. The driver housing is held in place by an ear clip that engages an exterior portion of the user's ear and attaches to the driver housing by way of a bridge element that can enclose other electronic components such as a battery, antenna, processor and the like.

19 Claims, 8 Drawing Sheets

EARPHONES

CROSS REFERENCES TO RELATED APPLICATIONS

This application claims priority to U.S. Provisional Patent Application No. 62/823,557, filed Mar. 25, 2019, the disclosures of which is hereby incorporated by reference in its entirety and for all purposes.

FIELD

This disclosure generally relates to features related to a wired or wireless earpiece. In particular, an earpiece configuration that maximizes the size of an audio driver housing for a given ear size is disclosed.

BACKGROUND

While wearable headphone devices have been in circulation for many years, achieving a good balance between sound output quality and a secure/comfortable fit can be challenging. For example, while a design that relies upon an earpiece tip engaging a user's ear canal to stay in place might provide good audio playback quality and passive noise cancellation, the design can also become uncomfortable to wear for long periods of time due to discomfort associated with the user's ear canal being responsible for supporting the earpiece. Similarly, while a design using a hook, ear clip or other retention device can keep the wearable headphone device securely in place, the hook or ear clip could cause a portion of the headphone designed to engage the ear to be misaligned. For the aforementioned reasons, a design that balances good sound output quality with a secure and comfortable fit is desirable.

SUMMARY

This disclosure describes various earpiece configurations well suited for producing high quality audio and fitting a broad range of users.

An earpiece is disclosed and includes the following: a driver housing having a first portion and a second portion; an ear clip; and a bridge element having a first end coupled to the driver housing and a second end coupled to the ear clip, the driver housing being tilted with respect to the bridge such that when the earpiece is being worn, the first portion rests in a concha bowl of an ear and the second portion tilts away and protrudes at least partially out of the ear.

An earpiece is disclosed and includes the following: a bridge element having a first end and a second end opposite the first end; an ear clip coupled to the first end of the bridge element; and a driver housing coupled to the second end of the bridge element at an angle such that a first portion of the driver housing tilts toward the bridge element and a second portion of the driver housing tilts away from the bridge element.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

As a general rule, and unless it is evident to the contrary from the description, where elements in different figures use identical reference numbers, the elements are generally either identical or at least similar in function or purpose.

DETAILED DESCRIPTION

Figure 1A:
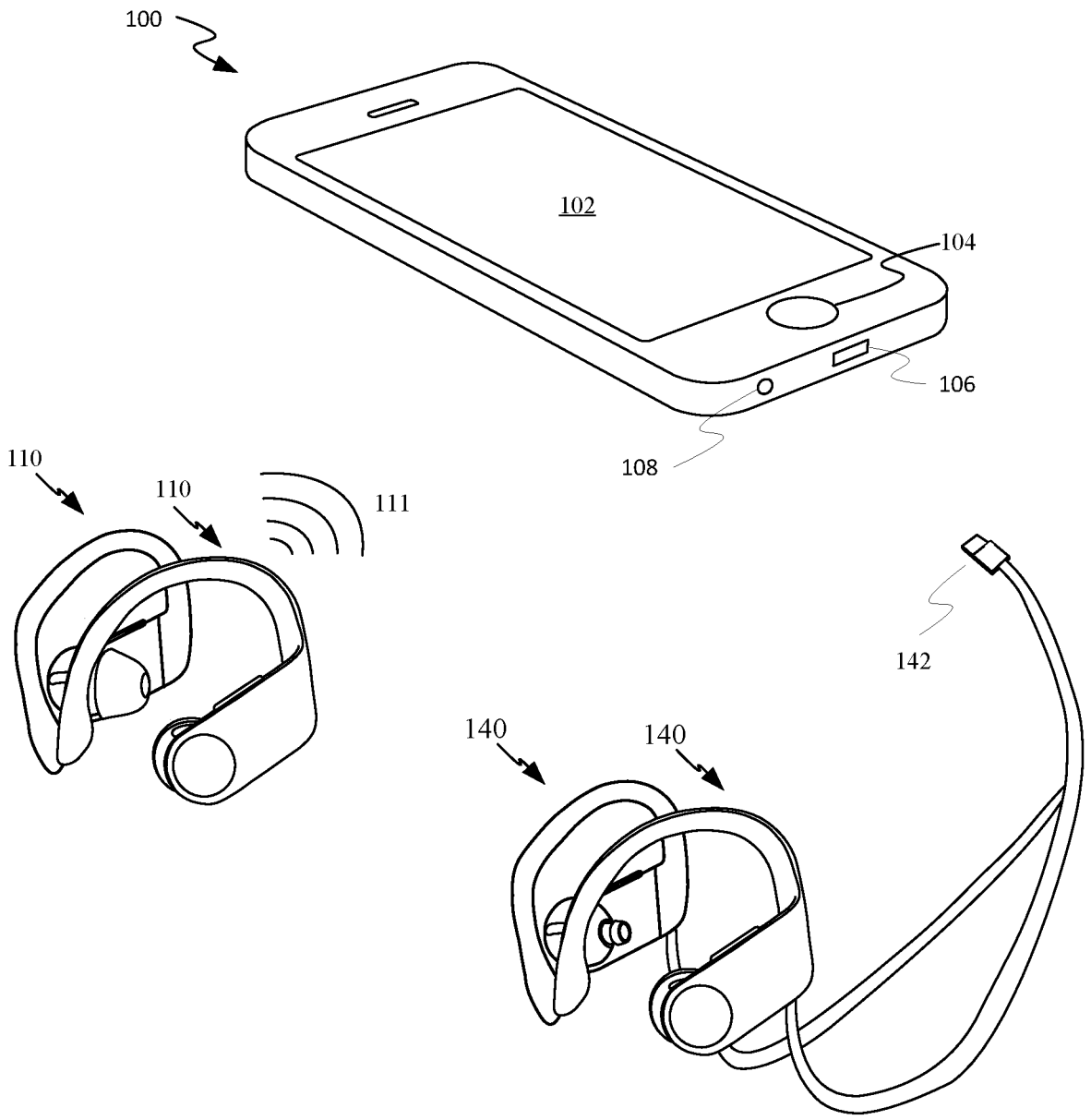
FIG. 1A shows an exemplary electronic device suitable for use with the described embodiments.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

An apparatus well suited to securing an earpiece within a user's ear is a key design feature for earpieces intended for use during exercise or other active goings-on. However, when securing mechanisms makes the earpieces uncomfortable to wear, the user will not get the maximum amount of utility from the earpieces since it will be harder to wear the earpieces for extended amounts of time, thereby negatively impacting the user experience. For example, a securing mechanism that presses the earpiece against sensitive portions of the ear can cause significant pain to a user making extended use of the earpiece unmanageable at best.

One solution to this proper fit issue is to optimize a design of the earpiece so that an overall shape of the earpiece conforms to as many internal features of a user's ear as possible. While no two ears are exactly the same, the earpiece can be designed to conform with features shared by a majority of the population. Equipping the earpiece with an ear clip reduces the need for a driver housing of the earpiece to rely solely upon the ear canal for stabilizing it and keeping it in place within the ear. Consequently, the stabilization provided by the ear clip allows the driver housing of the earpiece to be tilted away from the user's ear in a first direction so that the driver housing is positioned partially outside of a region of the ear between the concha bowl and crus helix. Because a portion of the driver housing can be positioned outside of the region, the driver housing can be larger and/or fit a larger population of users. Other refinements in the geometry of the driver housing include tilting the driver housing slightly away from the ear of the user in a second direction and slightly upward in a third direction. A nozzle of the driver housing can then be angled toward the ear canal of the user.

An earpiece tip of the earpiece that fits over the nozzle can be formed from conformal material and define a first acoustic pathway that is substantially longer than a second acoustic pathway defined by the nozzle. This configuration can result in further improvements in the fit and comfort of the earpiece as the earpiece tip conforms with the ear canal, thereby minimizing the application of uncomfortable forces upon the ear canal of the user. This conformal earpiece tip configuration is possible since the earpiece is supported both by a securing mechanism that engages an exterior of the user's ear and interaction between the driver housing and concha bowl. For at least these reasons, the earpiece tip need only provide a nominal amount of retaining force for the earpiece.

These and other embodiments are discussed below with reference to FIGS. 1A-7; however, those skilled in the art will readily appreciate that the detailed description given herein with respect to these figures is for explanatory purposes only and should not be construed as limiting.

FIG. 1A shows a portable media device 100 suitable for use with a variety of accessory devices. Portable media device 100 can include touch sensitive display 102 configured to provide a touch sensitive user interface for controlling portable media device 100 and in some embodiments any accessories to which portable media device 100 is electrically or wirelessly coupled. In some embodiments, portable media device 100 can include additional controls such as, for example, push button 104. Portable media device 100 can also include multiple hard-wired input/output (I/O) ports that include digital I/O port 106 and analog I/O port 108. An accessory device can take the form of an audio device that includes two separate earpieces 110. Each of earpieces 110 can include wireless receivers or transceivers capable of establishing a wireless link 111 to establish a two way communication pathway with portable media device 100. Earpieces 110 are shown including earpiece tips for establishing a sealed or substantially sealed acoustic pathway configured to deliver audio waves to the ear canal of a user. Alternatively, an accessory device can also be compatible with portable media device 100 and take the form of a wired audio device that includes earpieces 140. Earpieces 140 can be electrically coupled to each other and to a connector plug 142 by a number of wires. In some embodiments, the wires of earpieces 140 only electrically couple each other together, relying upon a wireless transceiver to communicate with portable media device 100. In embodiments where connector plug 142 is an analog plug, sensors within either one of earpieces 140 can receive power through analog I/O port 108 while transmitting data by way of a wireless protocol such as Bluetooth, Wifi, or the like. In embodiments where connector plug 142 interacts with digital I/O port 106, sensor data and audio data can be freely passed through the wires during use of portable media device 100 and earpieces 140. Earpieces 140 are shown with earpiece tips removed to show details of acoustic nozzles of earpieces 140.

Figure 1B:
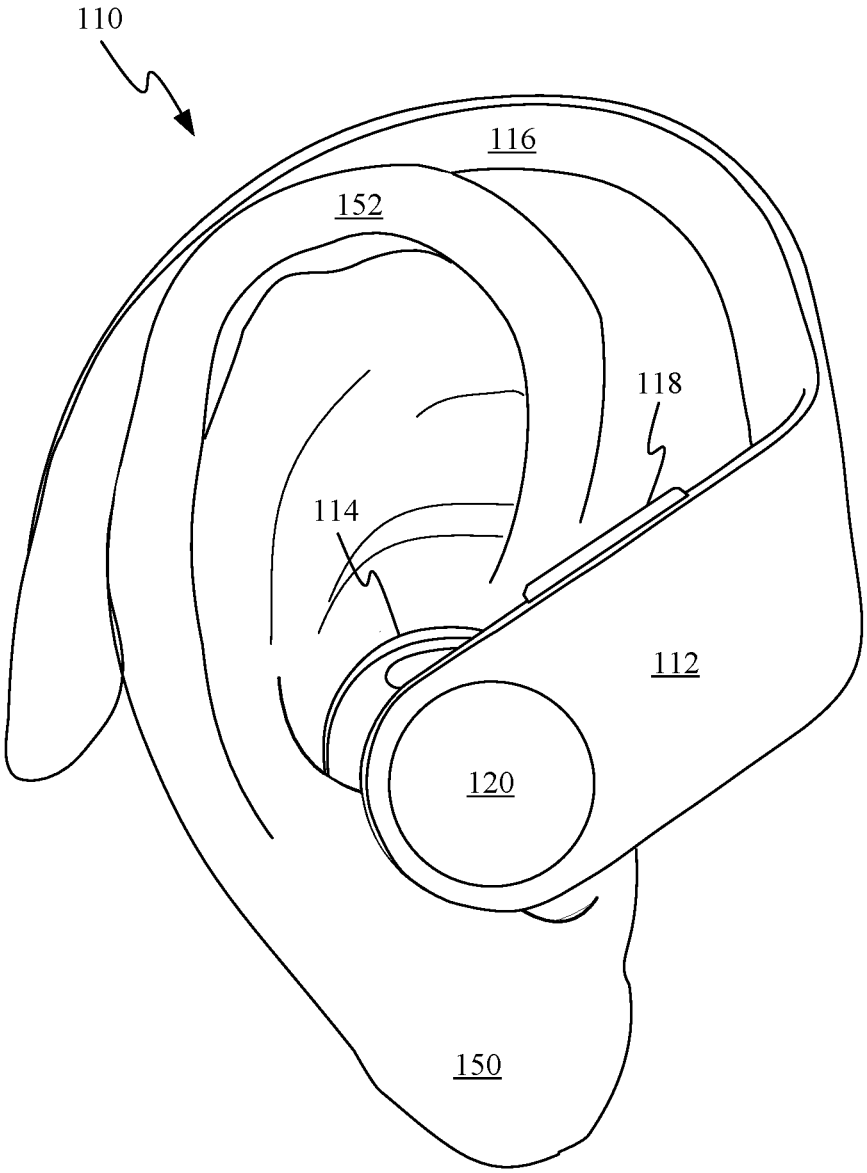
FIG. 1B shows an earpiece positioned within an ear of a user.

FIG. 1B shows a view of one of earpieces 110 positioned to generate audio waves and direct those audio waves into an ear 150 of a user. Earpiece 110 includes a bridge element 112 that takes the form of a housing component that encloses electrical components such as a battery, a wireless communication module, a processor/controller, a printed circuit board and the like within a first interior volume. A first end of bridge element 112 is coupled to a driver housing 114 and a second end of bridge element 112 opposite the first end is coupled to ear clip 116. In some embodiments, one or more of the electrical components within the first interior volume can be electrically coupled to an audio driver assembly enclosed by driver housing 114 within a second interior volume. The audio driver assembly can include components such as a permanent magnet, an electrically conductive coil, a diaphragm and other components generally associated with audio driver assemblies. In some embodiments, a flexible circuit can extend through an interior channel extending between the first interior volume defined by bridge element 112 and the second interior volume defined by driver housing 114. The flexible circuit can be configured to electrically couple the audio driver assembly to electrical components such as the printed circuit board within bridge element 112. In addition to enclosing electrical components that help support operation of the audio driver assembly within driver housing 114, bridge element can also include a number of user interface controls. For example, bridge element 112 includes user interface controls 118 and 110. In some embodiments user interface control 118 can take the form of a push button while in other embodiments user interface control 118 can take the form of a two position, three position, or multi-position slider switch. In some embodiments, ear clip 116 can take the form of a flexible clip configured to be supported within a channel defined by a pinna 152 of ear 150 and a side of a user's head. Ear clip 116 can optionally include other electrical components such as flexible battery cells that provide energy to earpiece 110 and/or one or more antenna elements that improve wireless performance of earpiece 110.

Figure 2:
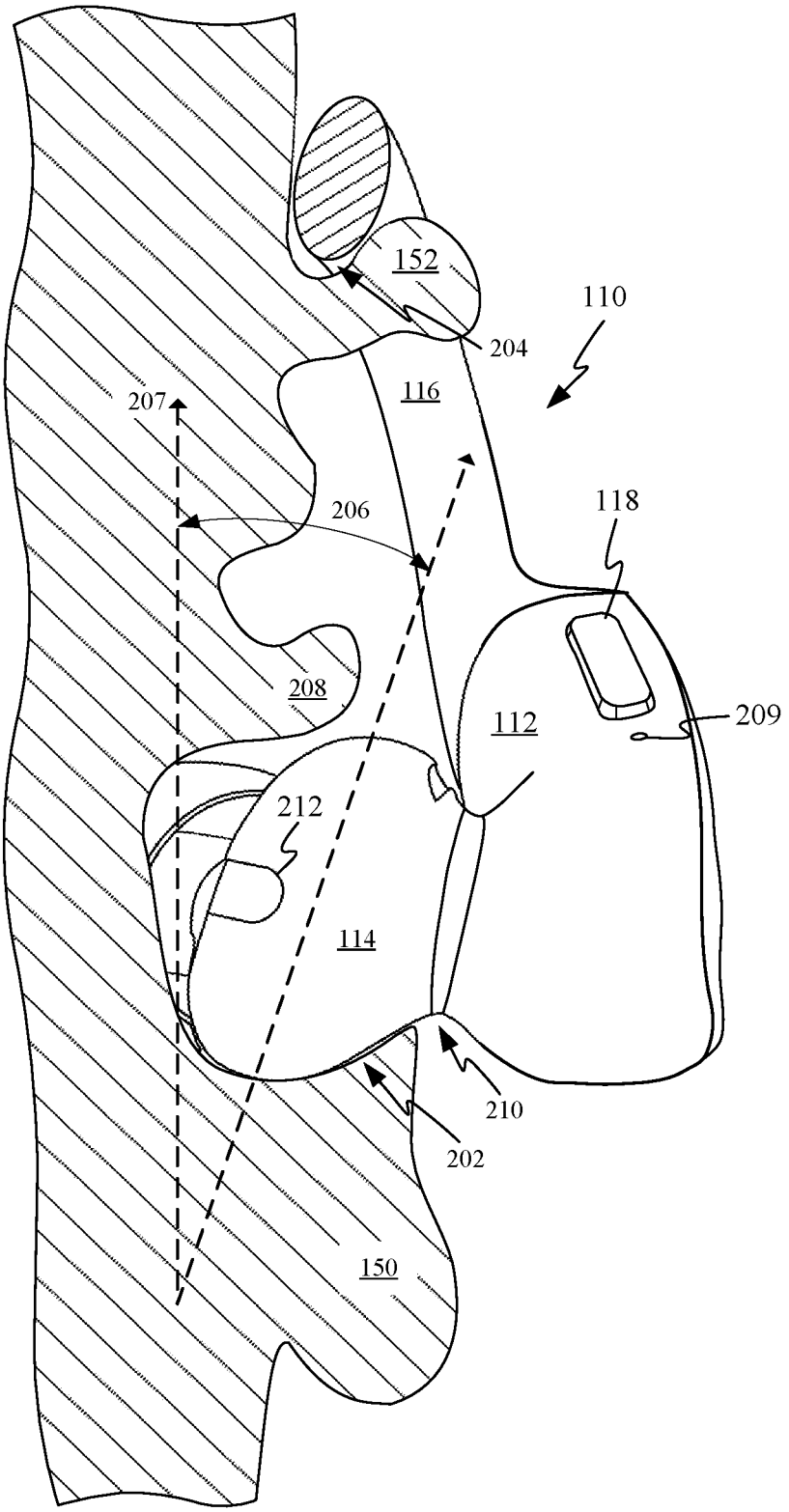
FIG. 2 shows a partial cross-sectional rear view of a driver housing supported by a concha bowl of an ear of a user.

FIG. 2 shows a partial cross-sectional rear view of driver housing 114 supported by a concha bowl 202 of an ear 150 of a user. Ear clip 116 is disposed within a channel 204 and engages a portion of ear 150 proximate pinna 152 of ear 150 and a side of a user's head. FIG. 2 also shows how driver housing 114 can be tilted at an angle 206 away from a vertical axis 207 so that an upper portion of driver housing 114 protrudes at least slightly out of ear 150. An angle 206 at which driver housing 114 is tilted can be between 10 and 30 degrees to reduce an effective height of driver housing 114 within the ear, thereby allowing for a larger driver housing and/or for a user with a smaller than average distance between concha bowl 202 and crus helix 208 to comfortably use earpiece 110. A driver housing design that remains clear of crus helix 208 can be quite important since crus helix 208 tends to be sensitive to any substantial amount of pressure. Consequently, engagement of crus helix 208 by driver housing 114 can cause the earpiece to be quite uncomfortable. By tilting the orientation of driver housing 114 in this way, the audio driver assembly within driver housing 114 can be substantially larger than it would otherwise be for a configuration in which driver housing 114 had a purely vertical orientation. Clearly were driver housing 114 oriented vertically driver housing 114 would be uncomfortable or completely unwearable as it would press into crux helix 208.

FIG. 2 also shows additional features of earpiece 110. In particular, a microphone opening 209 can be positioned proximate user interface control 118. In some embodiments, microphone opening 209 along with a corresponding microphone disposed within bridge element 112 can be configured to provide audio wave monitoring for facilitating the use of earpiece 110 for a phone call or for voice recording. Microphone opening 209 can also be configured to assist in an active noise cancelling system. Earpiece 110 can include a neck region 210 positioned at an interface between driver housing 114 and bridge element 112. Neck region 210 is tapered so that portions of earpiece 110 can avoid contact with a tragus and anti-tragus of ear 150 when earpiece 110 is worn within ear 150. A length of neck region 210 is sized to help position the bridge element and ear clip in the correct position based on the location of the driver enclosure within the concha. Earpiece 110 can also include a sensor window 212. In some embodiments, an infrared transmitter and receiver can be configured to transmit and receive infrared waves through sensor window 212 to measure a distance between driver housing 114 and one or more interior surfaces of ear 150. In this way, the distance measurement can be used to help determine whether or not earpiece 110 is currently being worn by a user. It should be noted that other types of optical sensors can be positioned behind sensor window 212.

Figure 3:
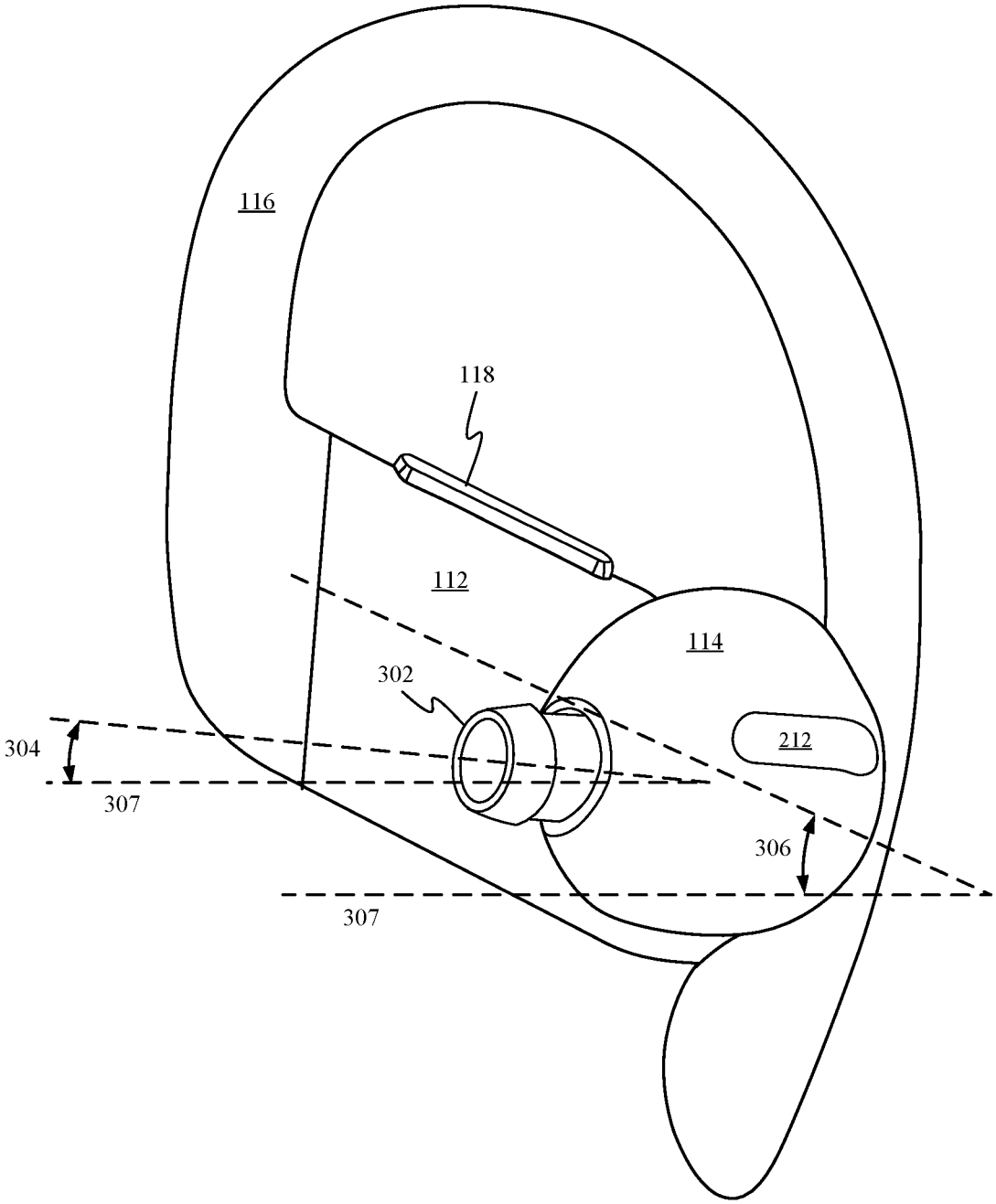
FIG. 3 shows a user facing side of an earpiece.

FIG. 3 shows a user facing side of earpiece 110. In particular a size and shape of driver housing 114 is depicted. Driver housing 114 includes a horizontally aligned sensor window 212 through which an optical sensor can determine a proximity of driver housing 114 to a user's ear. Driver housing 114 also includes a nozzle 302 through which audio waves propagate to a user of earpiece 110. Nozzle 302 is tilted slightly upward by an angle 304 of between 1 and 10 degrees. In some embodiments, this angle can be between 3 and 5 degrees. This slight upward tilt to nozzle 302 helps to align nozzle 302 more precisely with a user's ear canal, thereby helping earpiece fit a broader range of users. FIG. 3 also shows how bridge element 112 is oriented diagonally upward by an angle 306 from a horizontal axis 307 of between 30 and 60 degrees to attach to ear clip 116. In some embodiments, angling bridge element 112 upward by angle 306 in this manner can help avoid contact between bridge element 112 and a lower portion of a user's ear.

Figure 4:
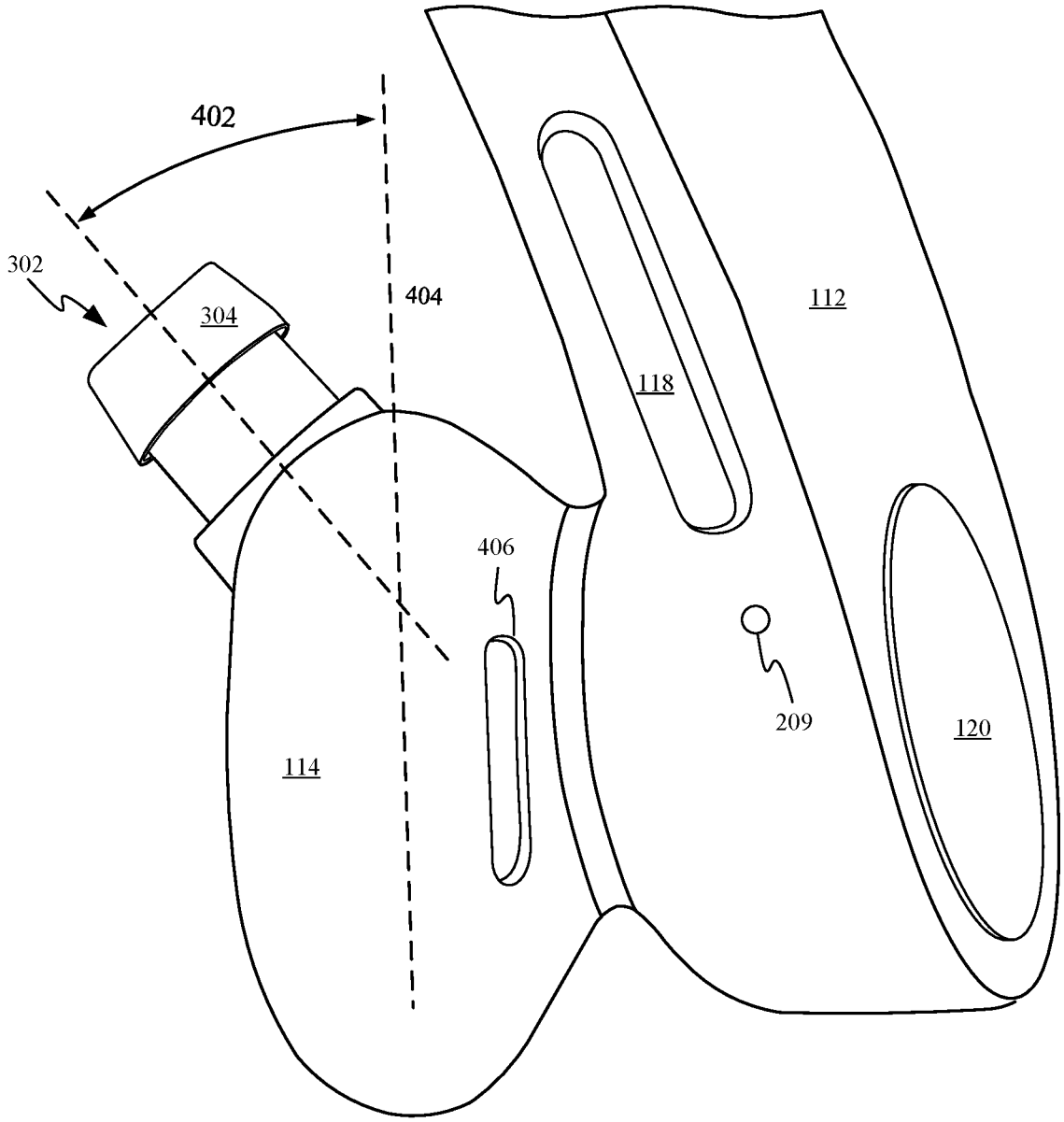
FIG. 4 shows an upward facing surface of a driver housing and how a nozzle can be angled inward toward a user's ear canal to align the nozzle with the ear canal of the user of an earpiece.

FIG. 4 shows an upward facing surface of driver housing 114 and how nozzle 302 can be angled inward toward a user's ear canal by an angle 402 of between 40 and 60 degrees with respect to a longitudinal axis 404 of driver housing 114 to more precisely align nozzle 302 with the ear canal of the user of earpiece 110. FIG. 4 also shows an acoustic port 406 positioned along an exterior of driver housing 114. Acoustic port 406 can be configured to expand an effective size of a back volume of air for an audio driver positioned within driver housing 114. Nozzle 302 is shown including a ridge 304 that helps keep an earpiece tip (not depicted) affixed to nozzle 302. FIG. 4 also depicts previously described user interface controls 118 and 110.

Figure 5:
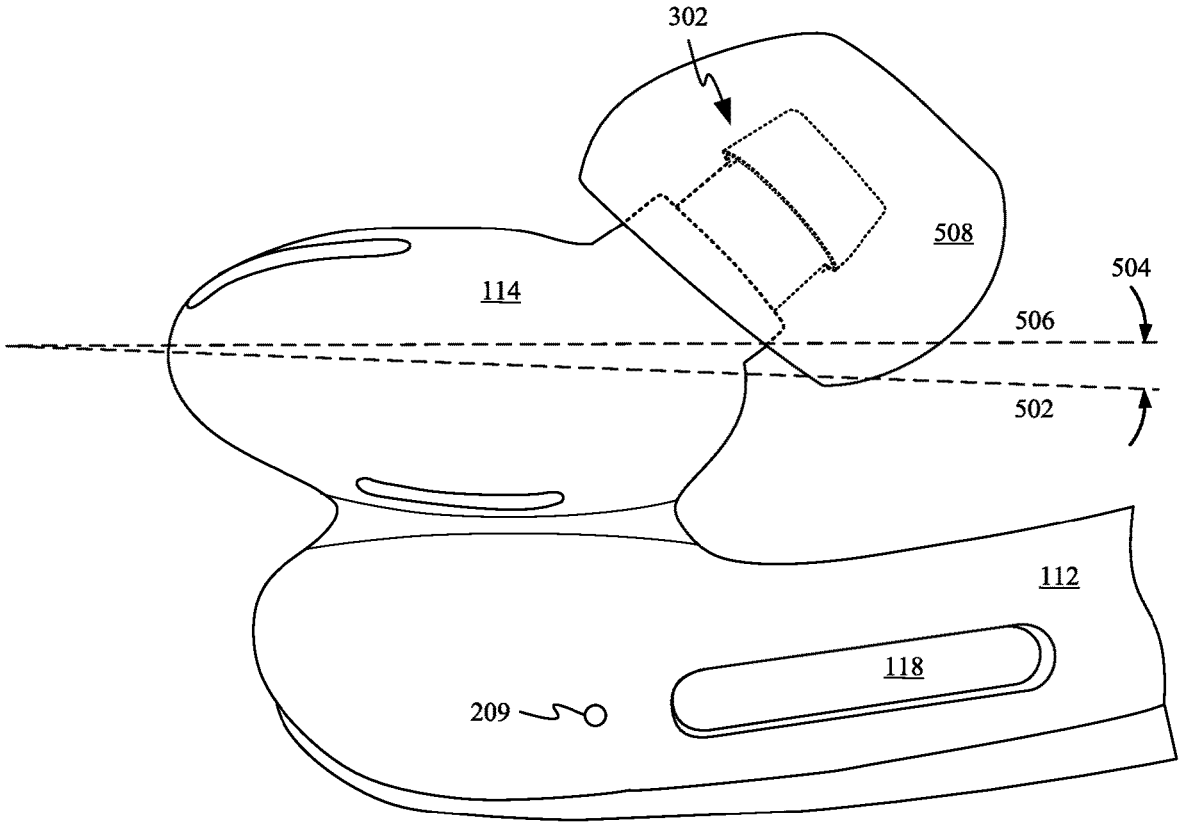
FIG. 5 shows a top view of a driver housing and how a forward end of the driver housing can be tilted slightly outward by an angle that follows a contour of a user's concha bowl.

FIG. 5 shows a top view of driver housing 114 and how a longitudinal axis 502 of driver housing 114 can be tilted slightly outward by an angle 504 from a horizontal axis 506 to follow a contour of a user's concha bowl. Angle 502 can be an angle of between 1 and 5 degrees. FIG. 5 also shows how an earpiece tip 508 can be affixed to nozzle 302. Earpiece tip 508 can be formed from conformal material such as silicone or rubber and helps establish a closed acoustic pathway between a distal end of nozzle 302 and an ear canal of a user. Because driver housing is held securely in place by an ear clip and internal features of a user's ear such as the concha bowl, earpiece tip 508 need not be responsible for retaining earpiece 110 in place. For this reason, earpiece tip 508 can be formed from particularly flexible materials well suited to provide a comfortable fit within the ear canal and conform to any irregularities positioned proximate to or within a user's ear canal.

Figure 6:
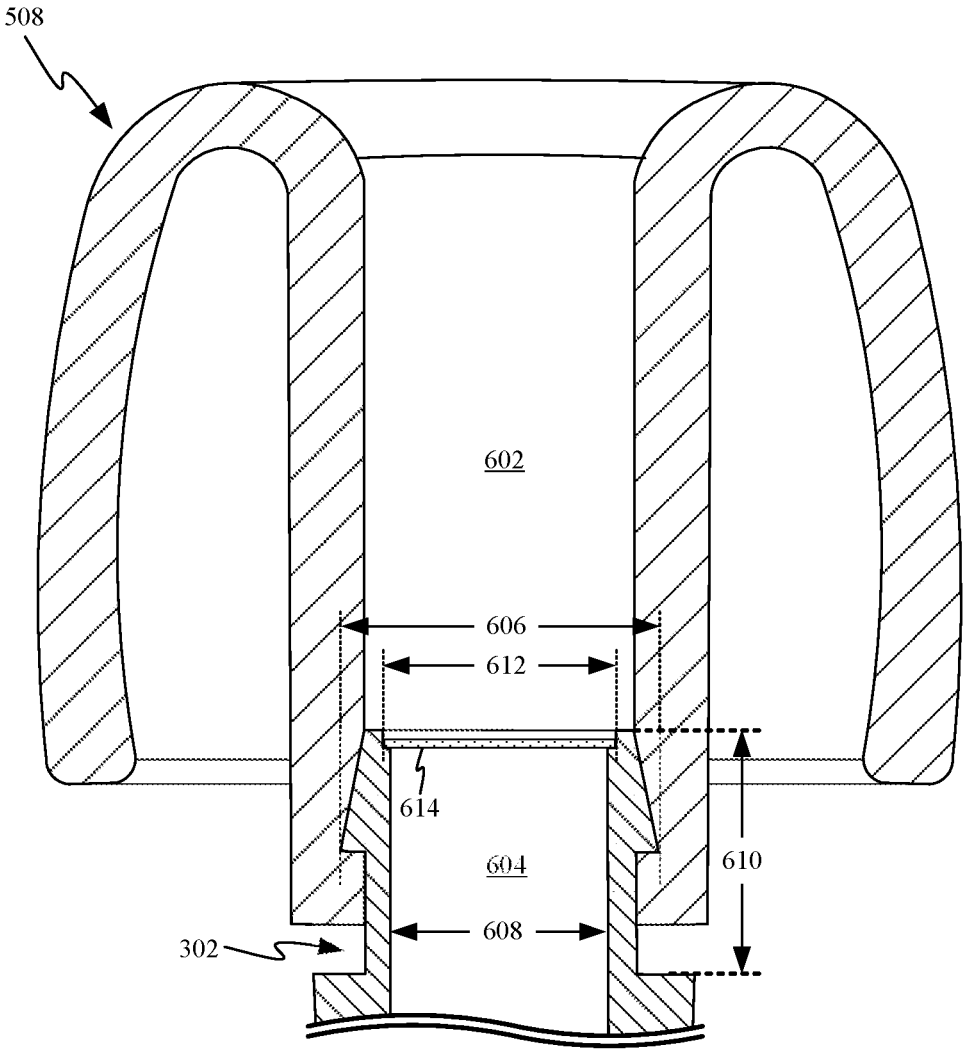
FIG. 6 shows a cross-sectional side view of an earpiece tip attached to nozzle of an earpiece.

FIG. 6 shows a cross-sectional side view of earpiece tip 508 attached to nozzle of an earpiece. In some embodiments, a length of a channel 602 defined by earpiece tip 508 can be substantially longer than a length of nozzle 302. In some embodiments and as depicted, a channel 602 defined by earpiece tip 508 can be two or three times as long as a channel 604 defined by nozzle 302. By reducing a length of the nozzle with respect to the earpiece tip an overall comfort of the earpiece tip within a user's ear can be improved since nozzle 302 need not enter the ear canal of the user as configured. This reduction in the length of nozzle 302 is possible since earpiece 110 does not rely solely upon the engagement of the ear canal by nozzle 302 and earpiece tip 508 to stabilize earpiece 110 within the user's ear. Similarly, an outer diameter of nozzle 302 can be substantially reduced as the outer diameter need not be wide enough to create a robust interference fit with the ear canal of a user. For example, an outer diameter 606 of nozzle 302 can be between 4 mm and 7 mm and an inner diameter 608 of nozzle 302 can be between 2 mm and 5 mm. In some exemplary embodiments, a length of nozzle 302 can have a length 610 of between 3 and 6 mm. It should be noted that a distal end of nozzle 302 can include a lip configured to support a mesh cover 614 configured to prevent the passage of foreign particles into channel 604 of nozzle 302.

Figure 7:
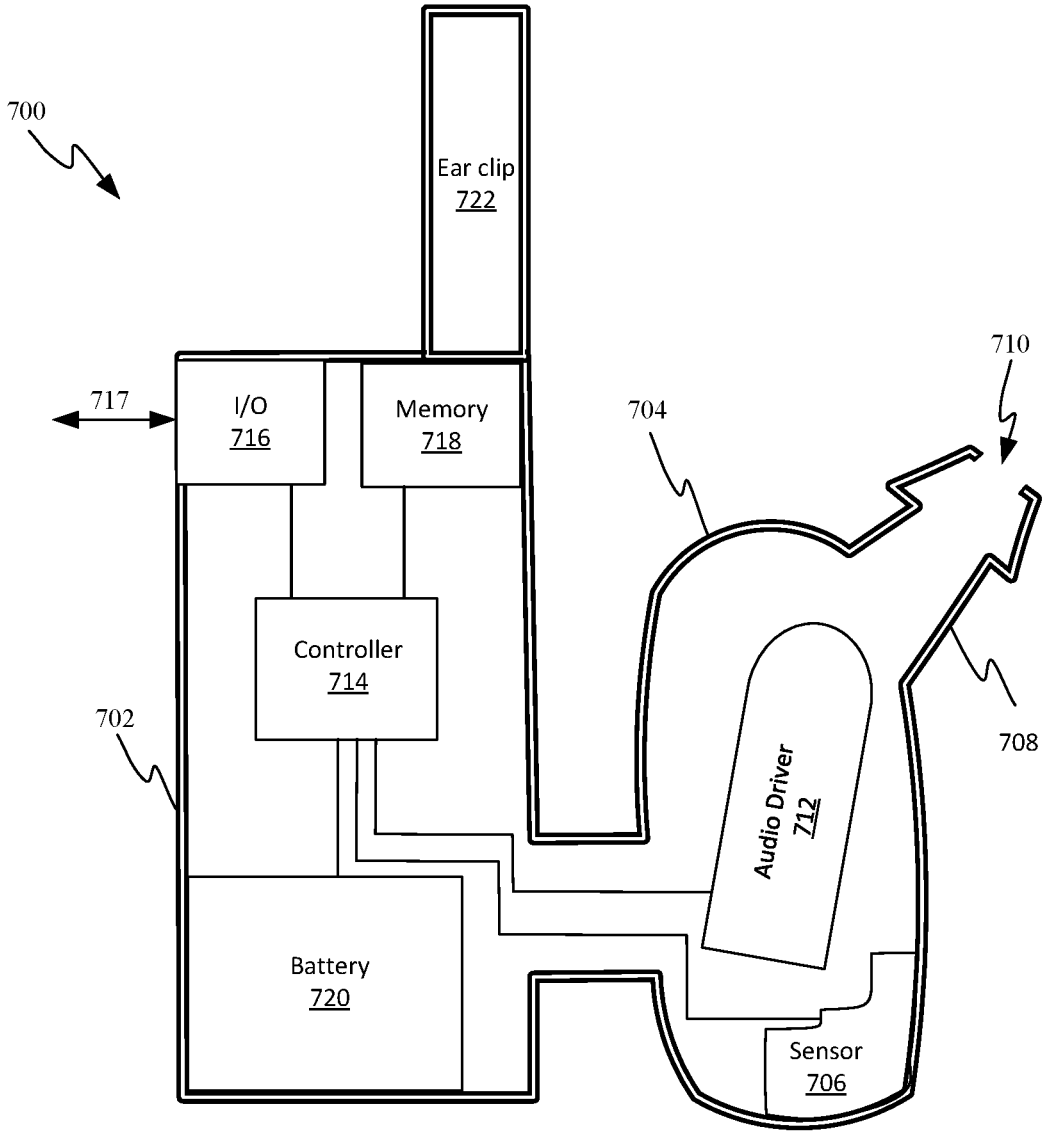
FIG. 7 shows a schematic diagram of an interior of an earpiece along with interior components disposed therein.

FIG. 7 shows a schematic diagram of an interior of earpiece 700 along with interior components disposed therein. The schematic view indicates how a geometry of earpiece 700 can differ in some respects from the embodiments shown in FIGS. 1-6. In some embodiments, earpiece 700 can include bridge element 702 and driver housing 704, which cooperatively form a device housing of earpiece 700. Driver housing 704 can have a size and/or shape that allows it to be easily inserted within the ear of an end user. The device housing defines an interior volume within which numerous electrical components can be distributed. In particular, a sensor 706 can be situated within or at least supported by driver housing 704. As depicted, sensor 706 can be arranged within and close an opening in driver housing 704. In this way, sensor 706 can have an exterior facing sensing surface capable of interacting with and measuring external stimuli. In some embodiments, sensor 706 can take the form of a proximity sensor. In other embodiments, sensor 706 can be a biometric sensor. Driver housing 704 can also include nozzle 708 with an opening 710 at a distal end of nozzle 708 that provides a channel through which audio signals generated by audio driver 712 can be transmitted out and into the ear canal of a user of earpiece 700, as indicated by the arrow.

In some embodiments, sensor 706 can take the form of a photoplethysmogram (PPG) sensor. A PPG sensor utilizes a pulse oximeter to illuminate a patch of skin and measure changes in light absorption of the skin. The pulse oximeter can include one or more light emitting devices and one or more light collecting devices. In some embodiments, the light emitting device can take the form of a light emitting diode (LED) and the light collecting device can take the form of a photodiode for measuring the changes in light absorption. The changes in light absorption can be caused by the profusion of blood within the skin during each cardiac cycle. Because the profusion of blood into the skin can be affected by multiple other physiological systems this type of biometric monitoring system can provide many types of biometric information. By capturing wave forms associated with the cycling profusion of blood to the skin, multiple biometric parameters can be collected including, for example, heart rate, blood volume and respiratory rate. By using LEDs that emit different wavelengths of light additional data can be gathered such as, for example, $VO_2$ max (i.e., the maximal rate of oxygen absorption by the body). By arranging sensor 706 in the depicted position with respect to driver housing 704, sensor 706 can be placed in close proximity to a user's ear, thereby allowing sensor readings made by a pulse oximeter. In some embodiments, sensor 706 can take the form of a core temperature sensor. Other embodiments of sensor 706 include embodiments in which sensor 706 takes the form of an electrode. When the earbud is a wired earbud electrically coupled to another earbud with an electrode, the electrodes can cooperatively measure a number of different biometric parameters. In some embodiments, the electrodes can be configured to measure the galvanic skin response (GSR) of a user. A GSR can be useful in determining an amount of stress being experienced by the user at any given moment in time. In some embodiments, the electrodes can be used to measure more detailed parameters of the heart rate by when the electrodes are configured as an electrocardiogram (EKG) sensor or an impedance cardiography (ICG) sensor.

Sensor 706 can be in electrical communication with at least controller 714, which is responsible for controlling various aspects of earpiece 700. For example, controller 714 can gather biometric sensor data recorded by sensor 706 and pass that data along to input/ouput (I/O) interface 710. I/O interface 716 can be configured to transmit the sensor data to another device such as, for example, portable media device 100 by way of wireless link 717 where I/O interface 716 takes the form of a wireless transceiver. Alternatively, I/O interface 716 can take the form of a wired connector similar to the configuration depicted with earpieces 140. In addition to providing a conduit for transmitting sensor data provided by sensor 706, I/O interface 716 can also be used to receive audio content that can be processed by controller 714 and sent on to audio driver 712. Audio driver 712 can include a diaphragm, driver magnet and electrically conductive coil for inducing the diaphragm to generate audio waves. I/O interface 716 can also receive control signals from a device similar to portable media device 100 for accomplishing tasks such as adjusting a volume output of audio driver 712 or modifying a sensitivity, priority or duty cycle of sensor 706. When I/O interface 716 takes the form of a wireless transceiver, I/O interface 716 can include an antenna configured to transmit and receive signals through an antenna window or an opening defined by bridge element 702. This can be particularly important when bridge element 702 is formed of radio opaque material. In some embodiments, I/O interface 716 can also represent one or more exterior controls (e.g. buttons and/or switches) for performing tasks such as pairing earpiece 700 with another device or adjusting various settings of earpiece 700 such as volume or the like.

Earpiece 700 can also include a memory 718, which can be configured to carry out any number of tasks. For example, memory 718 can be configured to store media content when a user of earpiece 700 wants to use earpiece 700 independent from any other device. In such a use case, memory 718 can be loaded with one or more media files for independent playback. When earpiece 700 is being used with another device, memory 718 can also be used to buffer media data received from the other device. In the independent use case described above, memory 718 can also be used to store sensor data recorded by sensor 706. The sensor data can then be sent to a device along the lines of portable media device 100 once the two devices are in communication.

With the exception of when I/O interface 716 is a wired interface that can provide power to earpiece 700 from another device or power source, battery 720 is generally used for powering operations of earpiece 700. Battery 720 can provide the energy needed to perform any of a number of tasks including: maintain a wireless link 717, powering controller 714, driving audio driver 712, powering sensor 702 and powering any other sensors disposed within earpiece 700 such as an accelerometer for tracking movement of the user. Other examples of sensors incorporated within earpiece 700 can include microphones, orientation sensors, proximity sensors or any other sensor suitable for improving the user experience of earpiece 700. In some embodiments, one or more of the sensors can be used in combination with sensor 702 to improve accuracy or calibrate various results. It should be noted that other exemplary sensors are not required in all of the embodiments described herein.

Earpiece 700 can also include a compliant ear clip 722 coupled with an exterior surface of bridge element 702. Compliant ear clip 722 can be configured to engage an upper portion of the ear of a user. As there can be large variations in the size and shape of the ears of any particular user, the compliant member allows earpiece 700 to conform to a number of different ear shapes and sizes. Furthermore, in some configurations compliant ear clip 722 can be removable so that various different ear clip sizes and shapes can be used to further customize the overall size of earbud 200 to the ear of any user. Compliant ear clip 722 can be made from any of a number of different types of materials including, for example, flexible polymeric materials, thin metallic clips and the like.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling the manufacturing or assembly operations described herein. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. An earpiece, comprising:

a driver housing having a first portion and a second portion;

an ear clip; and a bridge element having a first end coupled to the ear clip and positioned above a second end when the earpiece is worn by a user, the second end coupled to the driver housing such that an upper portion of the driver housing tilts toward the bridge element and a lower portion of the driver housing tilts away from the bridge element, the driver housing tilted with respect to the bridge element such that when the earpiece is worn by the user the lower portion of the driver housing rests in a concha bowl of the ear of the user and is positioned further in the ear of the user than the upper portion and the upper portion protrudes at least partially out of the ear.

2. The earpiece as recited in claim 1, wherein the ear clip is configured to wrap around and engage an upper portion of the ear of the user.

3. The earpiece as recited in claim 1, wherein the driver housing is angled from the lower portion to the upper portion at an angle of between 10 and 30 degrees relative to a side of the user's head.

4. The earpiece as recited in claim 1, further comprising a plurality of user input controls positioned upon the bridge element.

5. The earpiece as recited in claim 1, further comprising a neck portion between the driver housing and the bridge element, the neck portion having a substantially smaller diameter than the driver housing.

6. The earpiece as recited in claim 1, wherein the driver housing comprises a nozzle that protrudes from the driver housing and toward an ear canal of a user at an angle of between 40 and 60 degrees relative to a longitudinal axis of the driver housing.

7. The earpiece as recited in claim 6, further comprising an earpiece tip engaging a distal end of the nozzle, the earpiece tip defining a first acoustic channel that is more than twice as long as a second acoustic channel defined by the nozzle.

8. The earpiece as recited in claim 1, further comprising a battery disposed within an interior volume defined by the bridge element.

9. The earpiece as recited in claim 1, wherein the second end of the bridge element is angled between 30 and 60 degrees above the first end of the bridge element.

10. The earpiece as recited in claim 1, wherein the first end of the bridge element defines a microphone opening and the bridge element comprises a microphone positioned in the first end and oriented to receive audio waves through the microphone opening.

11. The earpiece as recited in claim 1, wherein the earpiece further comprises a sensor configured to measure a distance between the driver housing and one or more interior surfaces of the ear.

12. The earpiece as recited in claim 11, wherein the driver housing defines a sensor opening and the sensor is oriented to detect the distance through the sensor opening.

13. The earpiece as recited in claim 12, wherein the sensor is an infrared sensor.

14. An earpiece, comprising:

a bridge element having a first end and a second end opposite the first end, the first end positioned above the second first end when the earpiece is worn in an ear of a user;

an ear clip coupled to the first end of the bridge element; and a driver housing coupled to the second end of the bridge element at an angle such that an upper portion of the driver housing tilts toward the bridge element and a lower portion of the driver housing tilts away from the bridge element, the driver housing tilted with respect to the bridge element such that when the earpiece is worn in the ear of the user the lower portion of the driver housing is positioned further in the ear of the user than the upper portion.

15. The earpiece as recited in claim 14, wherein a central portion of the driver housing disposed between the upper and lower portions of the driver housing is coupled to the bridge element by a neck portion that has a smaller diameter than the driver housing.

16. The earpiece as recited in claim 15, further comprising a nozzle protruding from the driver housing at an angle of between 40 and 60 degrees relative to a longitudinal axis of the driver housing.

17. The earpiece as recited in claim 14, further comprising an audio driver disposed within the driver housing.

18. The earpiece as recited in claim 17, wherein a front of the audio driver is oriented to emit audio waves out of a first audio port defined by the driver housing and the driver housing further defines a second audio port configured to allow airflow between a back of the audio driver and the surrounding environment.

19. The earpiece as recited in claim 14, wherein the bridge element encloses a battery and at least a portion of an antenna.

* * * * *